US008825239B2

(12) United States Patent
Cooper et al.

(10) Patent No.: US 8,825,239 B2
(45) **Date of Patent: *Sep. 2, 2014**

(54) COMMUNICATION SYSTEM AND METHOD FOR A RAIL VEHICLE CONSIST

(75) Inventors: Jared Cooper, Palm Bay, FL (US); Todd Goodermuth, Melbourne, FL (US); David Peltz, Melbourne, FL (US); David McKay, Melbourne, FL (US); Scott C. Sherin, Rochester, NY (US); John Brand, Melbourne, FL (US); Eugene Smith, Melbourne, FL (US); David Teeter, Melbourne, FL (US); Robert Bryant, Melbourne, FL (US); Mark Kraeling, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 587 days.

This patent is subject to a terminal disclaimer.

(21) Appl. No.: 13/082,738

(22) Filed: Apr. 8, 2011

(65) Prior Publication Data

US 2011/0284699 A1 Nov. 24, 2011

Related U.S. Application Data

(63) Continuation-in-part of application No. 12/891,938, filed on Sep. 28, 2010, now Pat. No. 8,457,815, and a continuation-in-part of application No. 12/891,936, filed on Sep. 28, 2010, now Pat. No. 8,702,043, and a continuation-in-part of application No. 12/891,925, filed on Sep. 25, 2010, now Pat. No. 8,423,208.

(60) Provisional application No. 61/361,702, filed on Jul. 6, 2010, provisional application No. 61/346,448, filed on May 19, 2010.

(51) Int. Cl.

| | |
|---|---|
| ***G05D 1/00*** | (2006.01) |
| ***B61L 3/20*** | (2006.01) |
| ***B61L 15/00*** | (2006.01) |

(52) U.S. Cl.

CPC ..... *B61L 15/0036* (2013.01); *B61L 3/20* (2013.01)

USPC ..... 701/19; 188/153 R

(58) Field of Classification Search

USPC ..... 701/19; 188/206 R, 153 R; 105/168, 105/199.1; 295/7, 15, 21, 44

See application file for complete search history.

(56) References Cited

U.S. PATENT DOCUMENTS

| | | | |
|---|---|---|---|
| 1,517,549 | A | 12/1924 | Espenschied |
| 3,675,196 | A | 7/1972 | Molloy |

(Continued)

FOREIGN PATENT DOCUMENTS

| | | | |
|---|---|---|---|
| DE | 102005057273 | A1 | 5/2007 |
| EP | 0829415 | A1 | 3/1998 |

(Continued)

OTHER PUBLICATIONS

ISR and Written Opinion for International Application No. PCT/US2011/036159 dated Aug. 30, 2011.

(Continued)

*Primary Examiner* — Thomas Black
*Assistant Examiner* — Luke Huynh
(74) *Attorney, Agent, or Firm* — GE Global Patent Operation; John A. Kramer

(57) ABSTRACT

A method for communicating data in a rail vehicle consist includes transmitting first data at a first rail vehicle of the consist over a power supply conductor to a second, different rail vehicle in the consist, where at least one rail vehicle of the consist receives direct electrical power from the power supply conductor. The method also includes monitoring the power supply conductor for second data at the first rail vehicle and receiving the second data over the power supply conductor at the first rail vehicle for use by a first system onboard the first rail vehicle. In one aspect, the transmitting step comprises transmitting the first data over one or more of a catenary line or a third rail that supplies the electrical power.

21 Claims, 5 Drawing Sheets

(56) References Cited

U.S. PATENT DOCUMENTS

| | | | |
|---|---|---|---|
| 3,694,751 | A | 9/1972 | Takahashi |
| 3,714,419 | A | 1/1973 | Fosse |
| 3,715,669 | A | 2/1973 | LaForest |
| 3,750,020 | A | 7/1973 | Baba |
| 3,754,209 | A | 8/1973 | Molloy |
| 3,815,085 | A | 6/1974 | Leclercq |
| 3,835,950 | A | 9/1974 | Asano |
| 3,938,129 | A | 2/1976 | Smither |
| 3,949,959 | A | 4/1976 | Rhoton |
| 4,074,879 | A | 2/1978 | Clark |
| 4,207,569 | A | 6/1980 | Meyer |
| 4,369,942 | A | 1/1983 | Wilson |
| 4,420,133 | A | 12/1983 | Dietrich |
| 4,442,988 | A | 4/1984 | Laurent |
| 4,491,967 | A | 1/1985 | Kobayashi |
| 4,498,650 | A | 2/1985 | Smith |
| 4,645,148 | A | 2/1987 | Kolkman |
| 4,655,421 | A | 4/1987 | Jaeger |
| 4,910,793 | A | 3/1990 | Mainardi |
| 5,019,815 | A | 5/1991 | Lemelson |
| 5,056,873 | A | 10/1991 | Deno et al. |
| 5,132,682 | A | 7/1992 | Higgins |
| 5,208,584 | A | 5/1993 | Kaye |
| 5,248,967 | A | 9/1993 | Daneshfar |
| 5,309,155 | A | 5/1994 | Hsien |
| 5,330,134 | A | 7/1994 | Ehrlich |
| 5,339,782 | A | 8/1994 | Golzer |
| 5,342,120 | A | 8/1994 | Zimmer |
| 5,491,463 | A | 2/1996 | Sargeant |
| 5,507,456 | A | 4/1996 | Brown |
| 5,548,815 | A | 8/1996 | Takayama |
| 5,633,629 | A | 5/1997 | Hochstein |
| 5,636,907 | A | 6/1997 | Okazaki |
| 5,749,547 | A | 5/1998 | Young |
| 5,859,584 | A | 1/1999 | Counsell |
| 5,867,404 | A | 2/1999 | Bryan |
| 5,870,016 | A | 2/1999 | Shrestha |
| 5,901,683 | A | 5/1999 | Patel |
| 5,928,294 | A | 7/1999 | Zelinkovsky |
| 5,950,966 | A | 9/1999 | Hungate |
| 6,102,340 | A | 8/2000 | Peek |
| 6,216,985 | B1 | 4/2001 | Stephens |
| 6,313,589 | B1 | 11/2001 | Kobayashi |
| 6,317,031 | B1 | 11/2001 | Rickard |
| 6,384,735 | B1 | 5/2002 | Rabou |
| 6,400,281 | B1 | 6/2002 | Darby et al. |
| 6,445,150 | B1 | 9/2002 | Tanner |
| 6,452,482 | B1 | 9/2002 | Cern |
| 6,456,908 | B1 | 9/2002 | Kumar |
| 6,463,367 | B2 | 10/2002 | Neff |
| 6,504,485 | B2 | 1/2003 | Jinno |
| 6,688,561 | B2 | 2/2004 | Mollet |
| 6,830,224 | B2 | 12/2004 | Lewin |
| 6,856,865 | B2 | 2/2005 | Hawthorne |
| 6,862,502 | B2 | 3/2005 | Peltz et al. |
| 6,885,854 | B2 | 4/2005 | Stewart |
| 6,977,578 | B2 | 12/2005 | Kline |
| 7,006,012 | B2 | 2/2006 | Taoka |
| 7,038,597 | B2 | 5/2006 | Smith |
| 7,042,351 | B2 | 5/2006 | Kline |
| 7,072,408 | B2 | 7/2006 | Gehlot |
| 7,072,747 | B2 | 7/2006 | Armbruster |
| 7,075,414 | B2 | 7/2006 | Giannini |
| 7,076,343 | B2 | 7/2006 | Kornick |
| 7,079,926 | B2 | 7/2006 | Kane |
| 7,140,577 | B2 | 11/2006 | Mollet |
| 7,143,017 | B2 | 11/2006 | Flynn |
| 7,162,337 | B2 | 1/2007 | Peltz et al. |
| 7,164,368 | B1 | 1/2007 | Ireland |
| 7,222,003 | B2 | 5/2007 | Stull |
| 7,236,765 | B2 | 6/2007 | Bonicatto |
| 7,257,471 | B2 | 8/2007 | Kornick |
| 7,264,208 | B2 | 9/2007 | Kovach |
| 7,302,895 | B2 | 12/2007 | Kumar |
| 7,333,027 | B2 | 2/2008 | Bourgault |
| 7,336,156 | B2 | 2/2008 | Arita |
| 7,356,389 | B2 | 4/2008 | Holst |
| 7,467,032 | B2 | 12/2008 | Kane |
| 7,653,465 | B1 | 1/2010 | Geiger |
| 7,664,459 | B2 | 2/2010 | Smith, Jr. et al. |
| 7,667,344 | B2 | 2/2010 | Zitting |
| 7,688,218 | B2 | 3/2010 | Lefebvre |
| 7,948,398 | B2 | 5/2011 | Miller |
| 7,994,937 | B2 | 8/2011 | Hsu |
| 2001/0044695 | A1 | 11/2001 | Doner |
| 2003/0021441 | A1 | 1/2003 | Levy |
| 2003/0094545 | A1 | 5/2003 | Smith |
| 2003/0137191 | A1 | 7/2003 | Smith et al. |
| 2003/0210671 | A1 | 11/2003 | Eglin |
| 2003/0214417 | A1 | 11/2003 | Peltz et al. |
| 2005/0076716 | A1 | 4/2005 | Turner |
| 2005/0143868 | A1 | 6/2005 | Whelan |
| 2005/0143874 | A1 | 6/2005 | Peltz |
| 2005/0160169 | A1 | 7/2005 | Segal |
| 2005/0189815 | A1 | 9/2005 | Bryant |
| 2005/0197748 | A1 | 9/2005 | Holst |
| 2005/0228552 | A1 | 10/2005 | Kornick |
| 2006/0085103 | A1 | 4/2006 | Smith et al. |
| 2006/0170285 | A1* | 8/2006 | Morimitsu et al. ..... 307/3 |
| 2007/0219681 | A1* | 9/2007 | Kumar et al. ..... 701/19 |
| 2007/0228813 | A1 | 10/2007 | Smith |
| 2007/0236079 | A1 | 10/2007 | Kull |
| 2007/0241610 | A1 | 10/2007 | Smith |
| 2008/0033605 | A1 | 2/2008 | Daum |
| 2008/0087772 | A1 | 4/2008 | Smith |
| 2008/0159281 | A1 | 7/2008 | Jesseph |
| 2008/0173770 | A1 | 7/2008 | Ruggiero |
| 2008/0195265 | A1 | 8/2008 | Searle |
| 2009/0079560 | A1 | 3/2009 | Fries |
| 2009/0223760 | A1 | 9/2009 | Smith |
| 2010/0049384 | A1 | 2/2010 | Kraeling et al. |
| 2010/0049830 | A1 | 2/2010 | Chenu |
| 2010/0118988 | A1 | 5/2010 | Smith, Jr. et al. |
| 2010/0130124 | A1 | 5/2010 | Teeter et al. |
| 2010/0171609 | A1 | 7/2010 | Yeldell |
| 2010/0185472 | A1 | 7/2010 | Goodermuth et al. |
| 2010/0241295 | A1 | 9/2010 | Cooper |
| 2010/0332058 | A1 | 12/2010 | Kane |
| 2011/0099413 | A1 | 4/2011 | Cooper |
| 2011/0284700 | A1 | 11/2011 | Brand |
| 2012/0074266 | A1 | 3/2012 | Daum |
| 2012/0078452 | A1 | 3/2012 | Daum |
| 2012/0078453 | A1 | 3/2012 | Daum |

FOREIGN PATENT DOCUMENTS

| | | | |
|---|---|---|---|
| EP | 1065128 | A1 | 1/2001 |
| EP | 1601136 | A1 | 11/2005 |
| EP | 1693272 | A1 | 8/2006 |
| EP | 1719688 | A1 | 11/2006 |
| EP | 1886893 | A1 | 2/2008 |
| EP | 1897781 | | 3/2008 |
| EP | 1897781 | A2 | 3/2008 |
| KR | 20110039071 | A | 4/2011 |
| WO | 9842096 | A2 | 9/1998 |
| WO | 0171942 | A2 | 9/2001 |
| WO | 0222425 | A1 | 3/2002 |
| WO | 03098861 | A1 | 11/2003 |
| WO | WO 03098861 | | 11/2003 |
| WO | 2005102018 | A2 | 11/2005 |
| WO | WO 2005102018 | | 5/2006 |
| WO | 2006075767 | A2 | 7/2006 |
| WO | 2006134434 | A1 | 12/2006 |
| WO | 2007095401 | A2 | 8/2007 |
| WO | 2007121043 | A1 | 10/2007 |
| WO | WO 2007/121043 | | 10/2007 |
| WO | 2010059312 | A1 | 5/2010 |
| WO | WO 2010/059312 | | 5/2010 |
| WO | 2011042943 | A1 | 4/2011 |

OTHER PUBLICATIONS

ISR and Written Opinion for International Application No. PCT/US2011/042476 dated Aug. 31, 2011.

(56) References Cited

OTHER PUBLICATIONS

Search Report and Written Opinion for corresponding PCT Application No. PCT/US2010/053471, dated Jan. 21, 2011.
Search Report and Written Opinion from corresponding PCT Application No. PCT/US2011/055013, dated Apr. 10, 2012.
Hoerl, F. et al., "Multiple Radio Remote Control of Locomotives in Coupled Trains/Telecommande Multiple Par Radio D'Engins Dans Le Train", vol. 100, No. 3, pp. 105-109, Mar. 1, 2002.
Search Report and Written Opinion from corresponding PCT Application No. PCT/US2012/042675, dated Aug. 10, 2012.
Search Report and Written Opinion from corresponding PCT Application No. PCT/US2012/041858, dated Nov. 30, 2012.
Search Report and Written Opinion from corresponding PCT Application No. PCT/US2011/36159, dated Aug. 30, 2011.
Search Report and Written Opinion from corresponding PCT Application No. PCT/US2011/42476, dated Aug. 31, 2011.

* cited by examiner

COMMUNICATION SYSTEM AND METHOD FOR A RAIL VEHICLE CONSIST

CROSS-REFERENCE TO RELATED APPLICATIONS

This application claims priority to U.S. Provisional Application No. 61/346,448, entitled "Communication System And Method For Rail Vehicle Consist," and filed on May 19, 2010 (the "'448 Application") and to U.S. Provisional Application No. 61/361,702, entitled "Communication System And Method For Rail Vehicle Consist," and filed on Jul. 6, 2010 (the "'702 Application"). This application also is a continuation-in-part of U.S. application Ser. No. 12/891,938, filed on Sep. 28, 2010, and entitled "Rail Appliance Communication System And Method For Communicating With A Rail Appliance" (the "'938 Application"), U.S. application Ser. No. 12/891,936, filed Sep. 28, 2010, and entitled "Rail Vehicle Control Communication System And Method For Communicating With A Rail Vehicle" (the "'936 Application"), and U.S. application Ser. No. 12/891,925, filed on Sep. 28, 2010, and entitled "Rail Communication System And Method For Communicating With A Rail Vehicle" (the "'925 Application"). The entire subject matter of these applications (the '448, '702, '938, '936, and '925 Applications) is incorporated herein by reference in its entirety.

FIELD OF THE INVENTION

Embodiments of the invention relate to data communications. Other embodiments relate to data communications in a locomotive consist or other vehicle consist.

BACKGROUND OF THE INVENTION

A rail vehicle "consist" is a group of two or more rail vehicles that are mechanically coupled or linked together to travel along a route, as defined by a set of rails that support and guide the rail vehicle consist. One type of rail vehicle consist is a train, which may include one or more locomotives (or other powered rail cars) and one or more non-powered rail cars. (In the context of a rail vehicle consist, "powered" means capable of self propulsion and "non-powered" means incapable of self propulsion.) Each locomotive includes traction equipment for moving the train, whereas each rail car is configured for hauling passengers or freight. For producing motive effort, most modern locomotives use electric motors. In a typical case, a locomotive will include plural motors. For each motor, a pinion gear is attached to the output shaft of the motor, for driving a bull gear operably attached to a traction wheel set of the locomotive. For operation of the motor, the motor is supplied with electricity. In some locomotives, the locomotive may include an on-board power source for providing traction electricity (meaning electricity of suitable magnitude to power traction motors for moving a train). In other locomotives, traction electricity is received from an off-board source, such as a third rail or an overhead catenary line.

In a train or other rail vehicle consist, it may be desirable to communicate data from one rail vehicle in the consist to another rail vehicle in the consist. Such data may be used for control purposes, such as braking control or distributed power operations. (Distributed power refers to the coordinated control of plural locomotives or other powered rail vehicles which may be separated by unpowered vehicles and distributed throughout the rail vehicle consist.) Data may be communicated wirelessly (e.g., via radio waves), or over electrical lines that are at least partially disposed within the rail vehicles and extend between the rail vehicles in the consist. However, the former wireless communication is expensive to implement, and there may be signal quality issues due to RF interference and the like. The latter electrical line communication may provide a secure and noise-free communication channel, but it may not be possible to outfit a rail vehicle consist with an electrical line that extends along the entirety of the length of the consist. For example, many non-powered rail cars such as freight cars) do not include "built in" communication lines, and outfitting cars with such lines is expensive and impractical (that is, the cars are not designed to accept "add-on" communication lines). Further, even if all the rail vehicles in a rail vehicle consist are interconnected with a cable or other communication line, such lines may be subject to failure (e.g., detachable lines between adjacent cars becoming disconnected due to vibration).

BRIEF DESCRIPTION OF THE INVENTION

In one embodiment, a communication system for a rail vehicle in a rail vehicle consist is provided. The system includes an interface module and a transceiver unit. The interface module is configured to be electrically coupled to a power supply conductor (e.g., the power supply conductor is off-board the rail vehicle consist) that supplies direct electrical power to at least one rail vehicle in the consist, ("Direct" means the rail vehicle consist is in physical contact with the third rail or the catenary line, for receiving electrical power. "Third rail" means a rail whose purpose is to provide electrical power, as opposed to a "running rail," which is a rail that guides the rail vehicle consist and supports the weight of the rail vehicle consist.) The transceiver unit is coupled to the interface module and is configured to at least one of transmit or receive data over the power supply conductor through the interface module.

Another embodiment relates to a method for communicating data in a rail vehicle consist. The method comprises, at a first powered or other rail vehicle in the rail vehicle consist, transmitting data over a third rail or a catenary line or other off-board power supply conductor. The rail vehicle consist receives direct electrical power from the third rail or the catenary line. The method further comprises, at a second, different powered rail vehicle in the rail vehicle consist, monitoring the third rail or the catenary line for the data. Monitoring may include measuring electrical signals present on the third rail or the catenary line and identifying the data as being distinct from electricity intended to power the rail vehicle consist. The method further comprises, at the second powered rail vehicle in the rail vehicle consist, receiving the data for use by a first system onboard the second powered rail vehicle.

In another embodiment, another communication system for a rail vehicle in a rail vehicle consist is provided. The system includes an interface module, a transceiver unit, and a monitoring module. The interface module is configured to be electrically coupled to a power supply conductor that supplies direct electrical power to at least one rail vehicle in the consist. The transceiver unit is coupled to the interface module. The transceiver unit is configured to communicate data aver the power supply conductor through the interface module. The monitoring module is coupled to the transceiver unit and is configured to monitor the power supply conductor and determine a signal transmission characteristic of the power supply conductor. The transceiver unit switches from communicating the data over the power supply conductor to communicating data over an auxiliary communication pathway that extends across a neutral section of the power supply conductor based on the signal transmission characteristic.

Another embodiment relates to a method for communicating data in a rail vehicle consist. The method comprises, at a first rail vehicle in the rail vehicle consist, transmitting data over a running rail. At a second, different rail vehicle in the rail vehicle consist, the running rail is monitored for the data. The data is received at the second rail vehicle for use by a system onboard the second rail vehicle.

Another embodiment relates to a method for communicating data in a rail vehicle consist. The method comprises, at a first rail vehicle in the rail vehicle consist, transmitting data over a conductive wire or cable that is separate from but nm in close proximity to the train or rails. At a second, different rail vehicle in the rail vehicle consist, the adjacent wire or cable is monitored for the data. The data is received at the second rail vehicle for use by a system onboard the second rail vehicle.

Another embodiment relates to a communication system. The communication system comprises a respective router transceiver unit positioned in each of at least two rail vehicles of a rail vehicle consist. The router transceiver unit of each of the at least two rail vehicles is communicatively coupled to one of the following: a rail vehicle wheel set that is electrically coupled to a running rail or another conductive pathway (such as a wire or cable that is separate from, but extends along, nearby, or adjacent to the rail vehicles); or to an electric system of the rail vehicle that receives electric power from a third rail; or to a pantograph of the rail vehicle that receives electric power from a catenary line. For example, the router transceiver units may be electrically and/or conductively coupled with the running rail, third rail, catenary line, or other conductive pathway. By "electrically coupled," it is meant that the router transceiver units are able to communicate electric signals with the running rail, third rail, catenary line, or other conductive pathway with or without the presence of an additional conductive pathway (such as another bus, cable, or wire) extending therebetween. For example, "electrically coupled" may include inductive coupling. By "conductively coupled," it is meant that the router transceiver units are able to communicate electric signals with the running rail, third rail, catenary line, or conductive pathway extending along the rail vehicles through or over a conductive pathway that extends therebetween, "Electrically coupled" includes conductive coupling and other forms of communicative coupling, such as inductive coupling. Each router transceiver unit is configured to transmit and/or receive data over the running rail, or over the third rail, or over the catenary line, as applicable.

Other embodiments relate to a method and system for communicating with a rail vehicle. The method comprises transmitting data from the rail vehicle to an off-board location away from the rail vehicle. The data is transmitted from the rail vehicle to the off-board location over a running rail, or over a third rail, or over a catenary line. Equipment at the off-board location is configured for monitoring the running rail, third rail, and/or catenary line for identifying and receiving the data. The data may be network data, and/or high-bandwidth network data. The off-board location may be a dispatch center or other control center, a wayside device, or otherwise. In another embodiment, the method comprises transmitting data from an off-board location to a rail vehicle, over a running rail, or over a third rail, or over a catenary line. Equipment on the rail vehicle is configured for monitoring the running rail, third rail, and/or catenary line for identifying and receiving the data. The data may be network data, and/or high-bandwidth network data. The off-board location may be a dispatch center or other control center, a wayside device, or otherwise. In another embodiment, the method comprises transmitting data from a first off-board location of a rail vehicle infrastructure to a second off-board location, over a running rail, or over a third rail, or, over a catenary line of the rail vehicle infrastructure. Equipment at each off-board location is configured for monitoring the running rail, third rail, and/or catenary line for identifying, receiving, and/or transmitting the data. The data may be network data, and/or high-bandwidth network data. The off-board locations may each be a dispatch center or other control center, a wayside device, or otherwise. Other embodiments relate to communicating data (such as network data, and/or high-bandwidth network data) between one or more rail vehicles and/or off-board locations over a running rail, third rail, and/or catenary line, e.g., data may be transmitted from a rail vehicle to an off-board wayside device, over a running rail, third rail, and/or catenary line, and from the off-board wayside device back to the rail vehicle or to another rail vehicle.

In an embodiment, data (such as network data, and/or high-bandwidth network data) is transmitted from one location to another (e.g., rail vehicle, off-board location) concurrently over two or more of a running rail, third rail, and/or catenary line, for redundancy and communication backup purposes. For example, for communicating the data from one rail vehicle in a consist to another, or from a rail vehicle to an off-board location, one copy of the data is sent over the running rail, and another copy is sent over the third rail and/or catenary line. Each transceiver node (location having transmission and reception capability) is outfitted with equipment for communications over both/all of the two or more of the running rail, third rail, and/or catenary line.

In an embodiment, data (such as network data, and/or high-bandwidth network data) is transmitted from one location to another (e.g., rail vehicle, off-board location) over one or more of a running rail, third rail, catenary line, or other communication path or pathway (wireless or intra-consist wired). Selection among which of the communication pathways is used to communicate the data is made based on (i) availability of the communication pathways, (ii) respective or comparative signal qualities of the communication pathways, and (iii) the need or desire for data redundancy. Thus, if three communication paths are available (for example), such as a wireless communication pathway, a running rail, and a catenary line, the data may be communicated over the communication path having the best signal quality (for example, over the running rail), and, if redundancy is desired, also over the communication path having the second best signal quality (for example, over the catenary line), or over all three communication paths if more redundancy is desired (for example, multiple copies of the data are transmitted over the wireless connection, the running rail, and the catenary line).

In another embodiment, a method for communicating data in a rail vehicle consist is provided. The method includes transmitting first data at a first rail vehicle of the consist over a power supply conductor to a second, different rail vehicle in the consist, where at least one rail vehicle of the consist receives direct electrical power from the power supply conductor. The method also includes monitoring the power supply conductor for second data at the first rail vehicle and receiving the second data over the power supply conductor at the first rail vehicle for use by a first system onboard the first rail vehicle.

BRIEF DESCRIPTION OF THE DRAWINGS

The present invention will be better understood from reading the following description of non-limiting embodiments, with reference to the attached drawings.

DETAILED DESCRIPTION OF THE INVENTION

Figure 1:
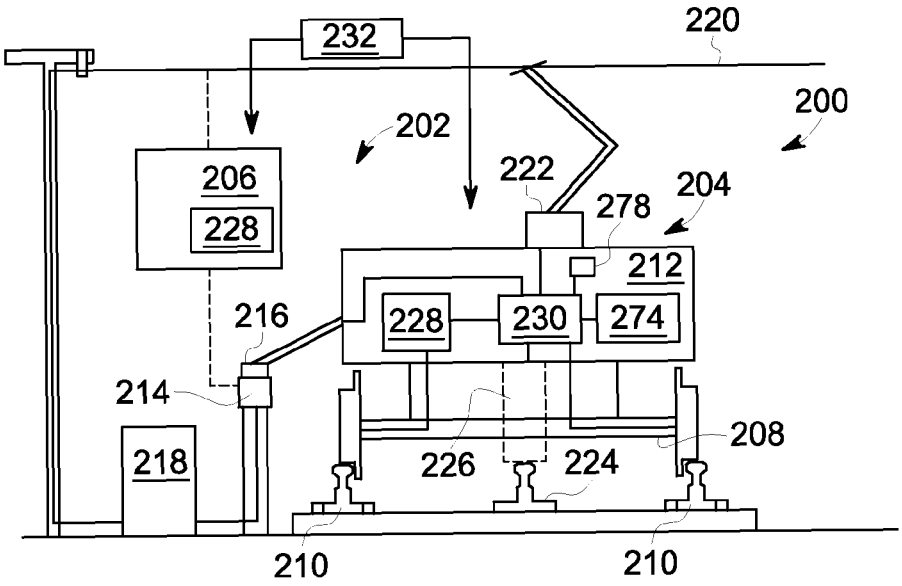
FIG. 1 illustrates an embodiment of the communication system and method. A vehicle is shown in lateral cross-section, but with a catenary line system shown transverse, for illustration purposes only. As should be appreciated, a catenary fine system and rails of a rail vehicle route would typically be parallel, not transverse.

One or more embodiments of the presently described inventive subject matter relate to a communication system and method for communicating data over supplemental non-wireless electrical pathways that may be available to a rail vehicle consist. In one embodiment of the communication system, rail vehicles are outfitted (such as by retrofitting an existing rail vehicle with additional equipment) with communication equipment for communicating data over a power supply conductor (e.g., off-board power supply conductor), which is a conductive pathway that also supplies electrical power to at least one rail vehicle in a rail vehicle consist. The power supply conductor may include a third rail or catenary line, such that one rail vehicle in a consist may communicate data with another rail vehicle in the consist over the third rail or catenary line. The communication of data may concurrently occur with the transmission of electrical power to one or more of the rail vehicles. For example, while electric current is supplied to a rail vehicle over, the power supply conductor, an electric signal containing the data may concurrently be communicated over the power supply conductor. The rail vehicle can differentiate the data from the electric current that supplies electric power based on one or more characteristics of the data, such as the frequency, amplitude, or other characteristics of the waveform of the signal containing the data.

In another embodiment, rail vehicles are outfitted with equipment for communicating data over a non-power supply conductor (e.g. off-board non-power supply conductor), such as a running rail or another conductive pathway that extends along the running rail that does not supply current to the rail vehicles to power the rail vehicles, such that one rail vehicle in a rail vehicle consist may communicate data with another rail vehicle in the consist over the running rail or non-power supply conductor. For example, instead of or in addition to communicating data through a power supply conductor, the rail vehicles may communicate data through a conductive pathway provided at least in part by the running rail or another cable, wire, or bus, with the data transmitted through the running rail, cable, wire, or bus. In another embodiment, the communication system is adapted to account for the presence of electrical breaks or neutral sections between sections/blocks of a running rail, catenary line, or third rail, such that communications using the communication system are possible between rail vehicles in a consist even if the rail vehicles are separated by an electrical break or neutral section. For example, the power supply conductor and/or running rails may be divided into sections (or blocks) that are electrically separated from each other such that adjacent or neighboring conductive sections are spatially separated from each other by a gap or dielectric material (referred to herein as a "neutral section"). The communication system may be adapted to communicate data between rail vehicles in a consist when the rail vehicles are coupled with the power supply conductor or running rail on opposite sides of the neutral section. The communication system may switch from communicating the data over the power supply conductor or running rail to communicating the data over another, on-board communication pathway that is at least partially disposed on-board the consist and extends between the communicating rail vehicles when the neutral section is disposed between the communicating rail vehicles. (Alternatively, or additionally, the communication system may be outfitted with an off-board auxiliary communication pathway for communications across neutral sections.) The communication system can switch back to communicating over the power supply conductor or running rail when the neutral section is no longer disposed between the communicating rail vehicles.

FIG. 1 illustrates an embodiment of the communication system and method 200. A rail vehicle consist 202 includes at least two (first and second) powered rail vehicles 204, 206. The second vehicle 206 is shown schematically. While the discussion herein focuses on the first vehicle 204, the discussion may equally apply to the second vehicle 206. Each vehicle 204, 206 includes plural wheel sets 208 for traveling over a pair of running rails 210, and a platform assembly 212 operably coupled to the wheel sets 208, for holding/supporting the other equipment/components of the rail vehicle 204. (The assembly 212 is shown schematically in FIG. 1.) Each rail vehicle 204, 206 may include an on-board power source, such as a diesel engine. Alternatively, electrical power may be received from off-board the rail vehicle 204, 206. For example, the rail vehicle consist 202 may include electrified powered vehicles 204, 206 (i.e., the powered vehicles of the consist 202 do not include on-board power sources, but instead function solely by receiving electrical power from off-board sources). The rail vehicles 204, 206 may receive power from a power supply conductor, such as a third rail 214 or an overhead catenary line 220 or other off-board power supply conductor. For this purpose, the rail vehicle 204 may include an interface module that receives electric current from the power supply conductor. In one embodiment, the interface module includes a shoe 216 that receives electric current to power the rail vehicle 204 as the shoe 216 physically contacts and runs along the third rail 214 as the vehicle 204 moves. The third rail 214 may receive electrical power from a feeder station 218 (e.g., electrical substation or the like), possibly located, along the third rail 214, but in any even located off-board the rail vehicle consist 202. The feeder station 218 may receive electrical power from a utility grid.

In another example of receiving off-board electrical power, the rail vehicle 204 may receive electrical power from the overhead catenary line 220. For this purpose, the rail vehicle 204 is outfitted with a pantograph 222 as an interface device that contacts and runs along the catenary line 220 as the rail vehicle 204 moves. The catenary line 220 receives electrical power from the feeder station 218. In operation for receiving electrical power from an off-board source, electrical power is received by the rail vehicle 204 from the third rail 214 or catenary line 220, is used within the rail vehicle 204 for powering electrical traction motors or otherwise, and return current is passed through the wheel set 208 to the running rails 210, or to a fourth (return) rail 224 (electrically coupled to the rail vehicle 204 via a return device 226, shown schematically), or the like.

Figure 2:
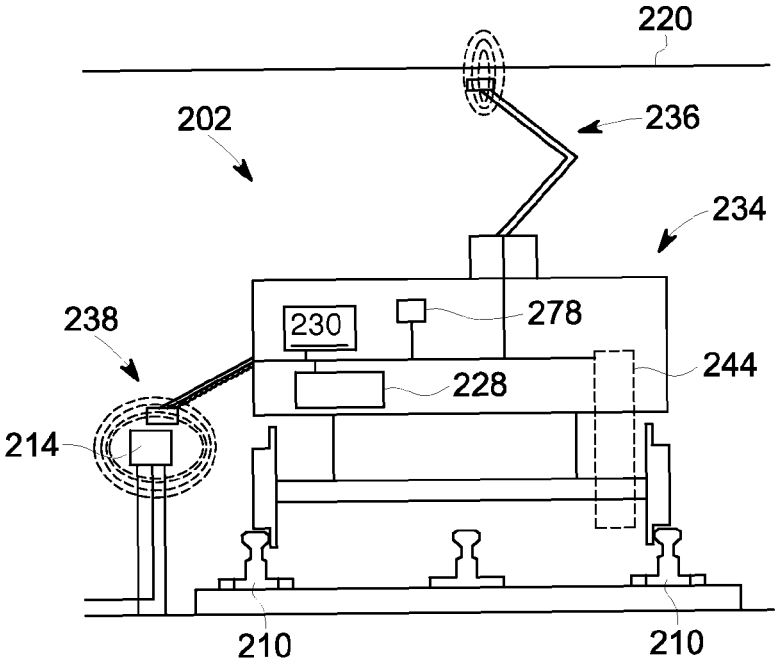
FIG. 2 is a schematic of a non-powered rail vehicle, according to another embodiment of the communication system.

In another embodiment, with reference to FIG. 2, the rail vehicle consist 202 includes one or more non-powered rail vehicles 234 that are outfitted with one or more components for attachment to the power supply conductor and/or running rail 210 for data communication. The rail vehicle 234 includes one or more on-board, non-traction systems that use electrical power, such as an ECP braking system 244. For powering the on-board, non-traction system, the rail vehicle 234 includes an interface module, such as an inductive power coupler 236, 238. The inductive power coupler 236, 238 may be a transformer, magnet, wire, coil, or combination thereof, which is disposed proximate to, but not physically touching, a third rail 214 or catenary line 220. ("Proximate to" means sufficiently close for inducing electrical power as required for powering one or more designated on-board, non-traction systems of the rail vehicle) Inductive coupling is used to avoid extra wear as might occur on the catenary line 220 or third rail 214. The rail vehicle 234 can use power, derived inductively, to power the communication and control subsystems or other on-board, non-traction systems.

In an embodiment, the communication system 200 comprises a respective router transceiver unit 228 positioned in each of a plurality of the rail vehicles 204, 206, 234 in the consist 202. The router transceiver units 228 are electrically coupled to interface modules disposed on-board the rail vehicles 204, 206, 234. The interface modules are conductively coupled with one or more communication pathways over which the data 232 is communicated. For example, the interface modules may communicate data 232 over power supply conductors, such as the catenary line 220 or third, rail 214, or over a non-power supply conductor, such as the running rail 210 or another conductive pathway that extends along the running rail 210. The term "running rail" may refer to the rail that guides and supports the rail vehicles 204, 206, 232 and/or another conductive pathway that extends along the running rail outside of the rail vehicles 204, 206, 232 that does not supply power to the rail vehicles 204, 206, 232. By way of example, the interface modules may include pantographs 222 that couple with an overhead catenary line 220, the shoes 216 that couple with the third rail 214, or the wheel sets 208 that engage the running rails 210. Each router transceiver unit 228 is configured to transmit and/or receive data 232 via the interface module and over the running rail 210, or over the third rail 214, or over the catenary line 220, as applicable, for communicating the data 232 between the rail vehicles 204, 206, 234. For example, the router transceiver units 228 may transmit data 232 through the interface module and over a power supply conductor (e.g., catenary line 220 or third rail 214) and/or over one or more running rails 210 that guide and support the rail vehicles 204, 206, 234.

In an embodiment, the data 232 is transmitted and received by the router transceiver units 228 as network data. Network data includes data that is communicated as data signals or data packets, such as according to the TCP/IP protocol. For example, the data may be transmitted in sequential packets of data having a header containing addressing information and an envelope containing information that is communicated using the data packets.

The data 232 may be transmitted over the power supply conductor and/or running rail 210 as high-bandwidth network data. High-bandwidth network data includes data transmitted at a frequency of at least 1 MHz, at least 100 kHz, or at least 50 kHz. In another embodiment, the data 232 is transmitted at low frequencies. For example, the data 232 may be transmitted at frequencies below 1 MHz, below 100 kHz, or below 50 kHz. Alternatively, high-bandwidth network data may include data that is transmitted at average rates of 10 Mbit/sec or greater. In contrast, the data 232 may be communicated as "low bandwidth" data, or data that is transmitted at average rages of less than 10 Mbit/sec, or "very low bandwidth" data, such as data transmitted at average rates of 1200 bits/sec or less.

The data 232 can be communicated using differential signals. For example, the data 232 may be transmitted by applying a differential signal to the third rail 214 or running rails 210. The differential signal may be applied as a differential signal across or between the third rail 214 and a running rail 210, or between two running rails 210, across or between the third rail 214 and a ground reference, across or between a running rail 210 and the ground reference, across or between two or more of the catenary line 220, the third rail 214, and/or the running rail 210, and the like. Alternatively, the data 232 may be communicated as a single-ended signal.

Prior to transmitting the data 232 over the power supply conductor and/or the running rail 210, the router transceiver unit 228 may convert the data 232 into modulated network data 232' and then transmit the modulated network data 232' over the catenary line 220, third rail 214, and/or running rail 210. The router transceiver unit 228 of the rail vehicle 204, 206, 234 that receives the modulated network data 232' can de-modulate the data 232' back into the data 232, "Modulated" means converted from one form to a second, different form suitable for transmission over the catenary line 220, third rail 214, and/or running rail 210. "De-modulated" means converted from the second form back into the first form. The modulated data 232' may be orthogonal to non-network control information that is communicated over the catenary line 220, third rail 214, and/or running rail 210. "Non-network" control information refers to data or other information that may be used in the consist 202 for control purposes and/or which is not packet data. In another example, non-network control information is not packet data, and does not include recipient network addresses.

The data 232 (or modulated data 232') can be communicated between different rail vehicles 204, 206, 234 in the consist 202 to provide intra-consist communications. For example, the data 232 may contain information used to control tractive effort and/or pneumatic braking (or other braking) of the rail vehicles 204, 206, 234, such as information that is used for distributed power control of the consist 202. Alternatively, the data 232 may include information used by another electric system 230 of the rail vehicle 204, 206, 234 that receives the data 232. For example, the data 232 may be used for radio transmission, such as Voice over IP (VoIP) radio communications, to communicate trip profiles (e.g., instructions that direct the control of tractive and/or braking efforts provided by the rail vehicles 204, 206 during an upcoming trip), Positive Train Control (PTC), instructions and the like. In another example, the data 232 may be communicated over the catenary line 220, third rail 214, or running rail 210 for Electrically Controlled Pneumatic (ECP) or other braking control purposes.

As another example, the data 232 (or modulated data 232') may include sensor data. For example, one or more of the rail vehicles 204, 206, 234 can include active and/or passive sensors 278 that monitor characteristics of the rail vehicles 204, 206, 234. The sensors 278 may provide data to the router transceiver units 228 that represents the health or status of one or more of the rail vehicles 204, 206, 234. For example, the sensors 278 may monitor traction motors, engines, or other propulsion generating devices located on-board the associated rail vehicle 204, 206. The sensors 278 may measure the output of the propulsion generating devices to determine if any of the devices are decreasing the horsepower or other output. For example, the sensor 278 may measure the horsepower that is output by the traction motors in a rail vehicle 204 or 206. The sensor 278 can record the horsepower as the data 232 that is transmitted to another rail vehicle 204, 206, 234 along the catenary line 220, third rail 214, or running rail 210. Alternatively, if the measured horsepower falls below a threshold, then the sensor 278 may report the decrease in horsepower as the data 232 that is transmitted along the catenary line 220, third rail 214, or running rail 210.

In another example, the sensors 278 may monitor how much sand or fuel is stored on one or more of the rail vehicles 204, 206, 234. The sensor 278 on the non-powered rail vehicle 234 may measure how much remaining fuel is carried by the rail vehicle 234 and report the remaining fuel amount to the powered rail vehicle 204 as the data 232 or 232' no that the rail vehicle 204 can monitor how much fuel is left to power the consist 202. In another example, the sensors 278 may include infrared sensors that monitor the temperature of one or more components of the rail vehicles 204, 206, 234 (such as hot box detectors or overheated bearing or axle detectors), Global Positioning Devices (GPS) that detect the geographic location of the rail vehicles 204, 206, 234, battery sensors that measure the status or charge of a battery on one or more of the rail vehicles 204, 206, 231, electrical sensors such as surge sensors, fuse status sensors (e.g., sensors that monitor if a fuse has blown), pressure sensors that monitor the air pressure status of one or more components of the rail vehicles 204, 206, 234 (e.g., main reservoir pressure, brake pipe pressure, equalizing reservoir pressure, or brake cylinder pressure), and the like. Other sensors 278 that measure, detect, or sense vehicle data, or information that is representative of whether the rail vehicle 204, 206, 234 needs repairs or maintenance, may be provided. While these examples provide some sensors 278, other sensors 924 not explicitly described herein may be included. For example, any passive or active device that monitors, measures, or detects a quantity, state, or quality of something may be a sensor 278.

The sensor data is communicated to the router transceiver unit 228 of the corresponding rail vehicle 204, 206, 234. The router transceiver unit 228 may then transmit the sensor data as the data 232 (or modulated data 232') along the catenary line 220, third rail 214, and/or running rail 210 to another rail vehicle 204, 206, 234. For example, one of the rail vehicles 204, 206, 234 may be a central monitoring point for sensor data in that the rail vehicles 204, 206, 234 transmit the sensor data to the same rail vehicle 204, 206, or 234. In one embodiment, the sensor data is transmitted to the lead locomotive or lead powered unit of the rail vehicle consist 202. The lead locomotive or powered unit may use the sensor data to change the tractive and/or braking effort provided by the consist 202. For example, if the horsepower supplied by a trailing locomotive or powered unit in the consist 202 decreases based on sensor data from the trailing locomotive or powered unit, the lead locomotive or powered unit may increase the tractive effort supplied by another locomotive or powered unit in the consist 202. In another embodiment, the sensor data is monitored at the lead locomotive or lead powered unit of a distributed power rail vehicle consist 202 and transmitted to another rail vehicle 204, 206, 234, such as a remote or trailing locomotive or powered unit in the consist 202. The lead powered unit may use the sensor data to change the tractive and/or braking effort provided by the consist 202. For example, the lead powered unit may set a tractive and/or braking effort which is monitored by the sensors. The sensor data is transmitted to the remote powered unit where the remote powered unit may adjust the tractive and/or braking efforts of the remote powered unit based on the tractive and/or braking effort of the lead powered unit in the consist 202. For example, the remote powered unit may match the tractive and/or braking efforts provided by the remote powered unit to match the tractive and/or braking efforts provided by the lead powered unit.

In the illustrated embodiment, the rail vehicles 204, 206, 234 include monitoring modules 274 coupled to the router transceiver units 228. The monitoring modules 274 may represent a computer processor and/or a tangible and non-transitory computer readable storage medium (e.g. a computer memory such as a computer hard drive, RAM, ROM, DVD, CD, or hard-wired instructions), with the processor operating based on the instructions stored on the computer readable storage medium. The monitoring modules 274 examine one or more of the power supply conductors and/or running rails 210 for the data 232. The monitoring modules 274 can examine to differentiate the data 232 from other current or signals on the power supply conductor and/or running rails 210. For example, the monitoring modules 274 may measure electrical signals present on the third rail 214, catenary line 220, or the running rail 210 in order to identify the data 232 as being distinct from other electricity that is intended to power the rail vehicle consist 202 (e.g., the data 232 and the electricity intended to power the rail vehicle consist 202 may have different waveforms, frequencies, energies, and the like). The monitoring modules 274 may differentiate the data 232 from other electrical signals by comparing the frequency, amplitude, or other characteristics of the digital signal waveforms sensed on the power supply conductor and/or running rail 210 to a threshold or range of values. For example, the frequency of signals containing the data 232 may exceed a predetermined threshold or fall within a range of frequencies. Other non-data-containing signals may have lower frequencies and/or frequencies that fall outside the frequency range. The data 232 is then received at the second rail vehicle 206 for use by a first system 230 onboard the second rail vehicle 206, such as a propulsion subsystem (e.g., control system that varies the tractive and/or braking efforts of the rail vehicle 206).

In another embodiment, the communication system 200 is adapted to account for the presence of neutral sections, such as electrical breaks or gaps, in the power supply conductor or running rail 210 between adjacent or neighboring sections/blocks of the power supply conductor or running rail 210. The communication system 200 may account for the neutral sections such that communications using the communication system 200 are possible between rail vehicles 204, 206, 234 in the consist 202 even if a plurality of communicating rail vehicles 204, 206, 234 are separated by the neutral section. To explain further, with respect to the catenary line 220, different blocks or sections of the catenary line 220 can be provided with electrical power from different feeder stations 218. To prevent the risk of out-of-phase current supplies mixing, sections of the catenary line 220 that are fed or supplied with current from different feeder stations 218 may be electrically isolated from each other such that the current on one catenary line 220 is not passed to another catenary line 220. The isolation between the catenary lines 220 is achieved by using neutral sections, which may comprise a grounded section of wire/conductor that is separated from the live wires/conductors on either side by insulating material, designed so that a pantograph 222 of the rail vehicles 204, 206, 234 will smoothly run from one section to another section of the catenary line 220. In the case of third rails 214, blocks or sections of third rails 214 may be electrically isolated from one another, using insulated rail joints or the like. With respect to running rails 210, the running rails 210 may be divided into blocks or segments that are separated by an air gap. The air gap provides room for the blocks or segments of the running rails 210 to expand during elevated temperatures without contacting each other. The air gap also may provide electrical isolation between neighboring or adjacent segments of the running rails 210.

The rail vehicles 204, 206, 234 in the consist 202 may be spaced apart from one another by a distance. As a result, two or more rail vehicles 204, 206, 234 that are communicating with each other may become separated by a neutral section in the communication pathway over which the rail vehicles 204, 206, 234 are communicating. The neutral section can temporarily preclude or inhibit communications between the rail vehicles 204, 206, 234 over the power supply conductor or running rail 210 being used for communication, or interrupt ongoing communications between the spaced apart rail vehicles 204, 206, 234, Although the time period for such interruptions may be limited, emergency situations may arise where it would be beneficial to avoid interruption or disruption in the communications. For this purpose, in an embodiment of the communication system, the communication system 200 is configured for a first rail vehicle 204, 206, 234 in the consist 202 to identify a neutral section between a first block of the power supply conductor or running rail 210 being used for data communication and a second block of the power supply conductor or running rail 210. The first and second blocks of the power supply conductor or running rail 210 are electrically isolated from one another. For example, a "block" may represent a section or segment of the power conductor or running rail 210 that is electrically isolated from one or more neighboring sections or segments such that no conductive pathways extend between the sections or segments. At a time when the first rail vehicle 204, 206, 234 and a second rail vehicle 204, 206, 234 in the consist 202 are separated by the neutral section, the communication system 200 may switch from communicating the data 232 over the power supply conductor or running rail 210 to communicating the data 232 between the first rail vehicle 204, 206, 234 and the second rail vehicle 204, 206, 234 through the first and second blocks and an auxiliary communication pathway 246 (shown in FIG. 3) that connects the first and second blocks of the power supply conductor or running rail 210. In one embodiment, the communication pathway 246 may be independent of the rail vehicle consist 202, the running rail 210, and/or the power supply conductor. ("Independent" means that at least part of the communication pathway 246 is off-board the rail vehicle consist 202 and/or does not extend over the power supply conductor or running rail 210.) In another embodiment, the communication pathway 246 may be at least partially disposed on-board the rail vehicle consist 202, such as a cable bus, wire, or wireless connection extending between the rail vehicles 204, 206, 234. For example, the communication pathway 246 may be an existing cable bus, such as a Multiple Unit (MU) cable or an ECP train line, or an additional pathway, such as a fiber optic cable, an additional cable, or a wireless data connection.

Figure 3:
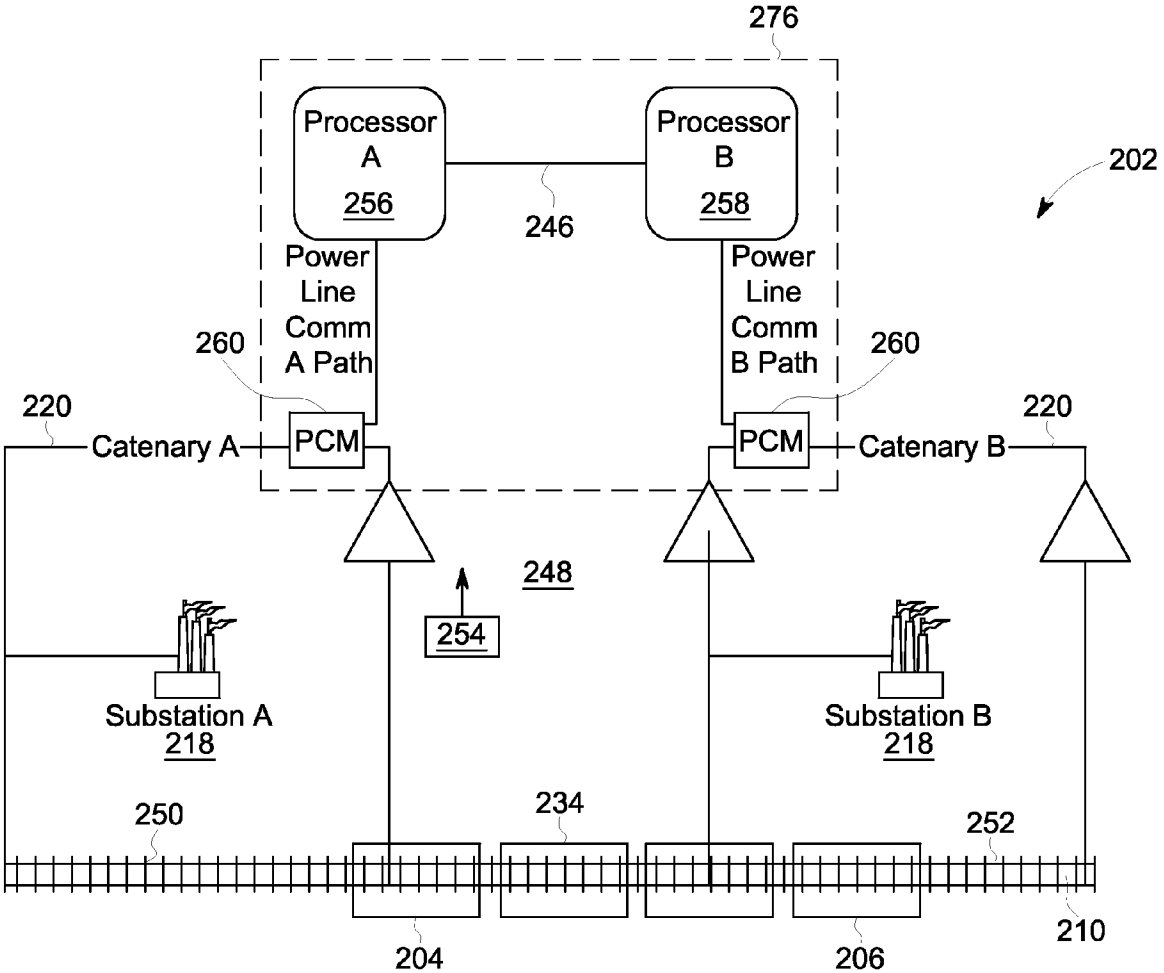
FIG. 3 is a schematic of another embodiment of the communication system.

FIG. 3 illustrates an embodiment of the communication system 200 that is used to communicate over a neutral section in the power supply conductor or running rail 210. The system 200 may be used to communicate data 232 across a neutral section 248 in the power supply conductor or running rail 210, such as a separation or gap. In the illustrated embodiment, two power feeder stations 218 ("Substation A" and "Substation B") are separately coupled with different electrically isolated sections or blocks 250, 252 of a catenary line 220. While the discussion herein focuses on the catenary line 220, the discussion may equally apply to a third rail 214 or a running rail 210. For example, the blocks 250, 252 can represent different, electrically isolated sections or blocks of the third rail 214 or the running rail 210.

The separate blocks 250, 252 are illustrated, as different parts of a track that the rail vehicles 204, 206, 234 travel along and with which the separate parts of the catenary line 220 ("Catenary A" and "Catenary B") are associated. For example, the block 250 represents the section of the catenary line 220 that is referred to as "Catenary A" and that supplies electric power to rail vehicles 204, 206, 234 travelling along the portion of the track that is pointed to by the block 250. The block 252 represents the section of the catenary line 220 that is referred to as "Catenary B" and that supplies electric power to rail vehicles 204, 206, 234 traveling along the portion of the track that is pointed to by the block 252. Alternatively, the blocks 250, 252 may represent electrically separate sections of the third rail 214 or running rail 210.

The interface modules (such as the pantographs 222) of the rail vehicles 204, 206, 234 engage the different blocks 250, 252 of the catenary line 220 to deliver power to the rail vehicles 204, 206, 234. A neutral section 248 disposed between the blocks 250, 252, or between the Catenary A and Catenary B sections, represents an area where the catenary line 220 does not provide power to the rail vehicles 204, 206, 234. For example, the neutral section 248 may indicate a gap in the catenary line 220 or a dielectric portion of catenary line 220. Alternatively, the neutral section 248 may represent a gap between neighboring, electrically separate sections of the third rail 214 or running rail 210.

In the illustrated embodiment, the communication system 200 includes off-board communication units 256, 258 ("Processor A" and "Processor B"). The communication units 256, 258 can represent computer processors and/or tangible and non-transitory computer readable storage media, with the computer processors operating based on sets of instructions, such as software applications, that are stored the media. The communication units 256, 258 are coupled with pulse code modulation (PCM) or similar equipment 260 ("PCM") that modulates and demodulates data 232 that is communicated over the power supply conductor or running rail.

The PCM equipment 260 is coupled with the communication unit 256, 258 in the corresponding rail vehicle 204, 206. For example, one of the PCM equipment 260 may be joined with the communication unit 256 by a "Power Line Comm A Path," such as a cable, bus, and the like, while another PCM equipment 260 is joined with the communication unit 258 by a "Power Line Comm B Path," such as another cable, bus, and the like. The communication units 256, 258 are communicatively coupled by the auxiliary communication pathway 246. The communication pathway 246 may be embodied in one or more cables, busses, wires, or wireless connections. For example, the communication pathway 246 may include fiber optic or conductive cable. The off-board communication units 256, 258, the PCM equipment 260, and the auxiliary communication pathway 246 form a communication bypass subsystem 276. The communication bypass subsystem 276 enables the rail vehicles 204, 206 to communicate with each other across the neutral section 248.

When the consist 202 has two or more rail vehicles 204, 206, 234 connected to different blocks 250, 252 of the catenary line 220, third rail 214, or running rail 210, the rail vehicles of the consist 202 that are coupled to the different blocks 250, 252 may be treated as different sides or sections of the consist 202. In one embodiment, the rail vehicles of each side or section in the consist 202 can communicate with each other independent of communications between the rail vehicles of another side or section in the consist 202. For example, the rail vehicles that are coupled with the Catenary A can communicate with each other over the Catenary A (the "Catenary A side") while the rail vehicles that are coupled with the Catenary B (the "Catenary B side") can communicate with each other over the Catenary B. Due to the neutral section 248, the Catenary A side may be unable to communicate with the Catenary B side over one or more of the catenary 220, third rail 214, or running rail 210.

The Catenary A side can communicate with the Catenary B side via the communication pathway 246. For example, prior to the rail vehicles 204, 206 234 of the consist 202 being divided into the Catenary A and Catenary B sides, the rail vehicles 204, 206, 234 may communicate the data 232 over the catenary 220. After one or more of the rail vehicles 204, 206, 234 passes the neutral section 248 (thus forming the Catenary A side) and one or more other rail vehicles 204, 206, 234 disposed on the other side of the neutral section 248 (thus forming the Catenary B side), the communication system 200 switches to communicating the data 232 over the communication pathway 246. For example, when the rail vehicle 204 is in contact with the Catenary A of the block 250 and the rail vehicles 206, 234 are in contact with the Catenary B of the block 252, the rail vehicles 204, 206, 234 may communicate the data 232 through the communication pathway 246. When the rail vehicles 204, 206, 234 are later in contact with the same block 250 or 252, such as by the rail vehicles 204, 206, 234 being in contact with and electrically coupled with each other through the same section of catenary line 220, third rail 214, or miming rail 210, the rail vehicles 204, 206, 234 may return to communicating the data 232 through the same or common section of catenary line 220, third rail 214, or running rail 210.

In another embodiment, the communication pathway 246 may be an on-board communication pathway disposed on the consist 202 and extending between a plurality of the rail vehicles 204, 206, 234. For example, the communication pathway 246 may be present on board the rail vehicles 204, 206, 234 even when the rail vehicles 204, 206, 234 are in contact with the same or different blocks 250, 252 of the catenary line 220, third rail 214, or running rail 210. The communication pathway 246 may be embodied in one or more cables, buses, wires, or wireless connections between the rail vehicles 204, 206, and/or 234. For example, the communication pathway 246 may include fiber optic cable, a Multiple Unit (MU) cable, an ECP brake line over which brake control instructions are normally communicated, a wireless connection between the rail vehicles 204, 206, and/or 234, and the like. The router transceiver units 228 may switch from communicating the data 232 over the power supply conductor or running rail 210 to communicating the data 232 over the communication pathway 246 when two or more of the rail vehicles 204, 206, 234 are separated by the neutral section 248. The router transceiver units 228 may switch back to communicating over the power supply conductor or running rail 210 when the two or more rail vehicles 204, 206, 234 are coupled to the same block 250 or 252 of the power supply conductor or running rail 210.

In one embodiment, one or more of the rail vehicles 204, 206, 234 monitor the power supply conductor or running rail 210 to determine when the neutral section 248 is disposed between two or more of the rail vehicles 204, 206, 234 such that the neutral section 248 effectively severs communication between the two or more rail vehicles 204, 206, 234 over the power supply conductor or running rail 210. For example, the monitoring module 274 (shown in FIG. 1) on one or more of the rail vehicles 204, 206, 234 may examine the power supply conductor or running rail 210 to determine a signal transmission characteristic of the power supply conductor or running rail 210. The router transceiver units 228 of the rail vehicles 204, 206, 234 may switch from communicating over the power supply conductor or running rail 210 to communicating over the communication pathway 246 based on the signal transmission characteristic.

The monitoring module 274 may measure the signal transmission characteristic as a change in an electrical characteristic of the catenary line 220, third rail 214, or running rail 210, such as a change in conductivity, resistivity, and the like, of the catenary line 220, third rail 214, or running rail 210. When the monitoring module 274 detects the neutral section 248, the monitoring module 274 may direct one or more of the router transceiver units 228 to being transmitting the data 232 to the communication unit 256, 258 that is joined to the same block 250, 252 as the router transceiver units 228. The communication units 256 may convey the data 232 between each other (and across the neutral section 248) by communicating a message 254 over the communication pathway 246. The message 254 can include the data 232. When one or more of the monitoring modules 274 determine that the neutral section 248 is no longer disposed between the rail vehicles 204, 206, 234 such that the neutral section 248 would interrupt communication between the rail vehicles 204, 206, 234 through the power supply conductor or running rail 210, one or more of the monitoring modules 274 can direct the router transceiver units 228 to switch back to communicating the data 232 over the power supply conductor or running rail 210.

For example, the monitoring module 274 of the rail vehicle 204 or 206 that is located ahead or forward of the other rail vehicle 204 or 206 along the direction of travel of the rail vehicles 204, 206 monitors the catenary line 220, third rail 214, or running rail 210 for the neutral section 248 and directs the communication units 256, 258 to use the communication pathway 246 when the neutral section 248 is detected. The monitoring module 274 of the other rail vehicle 204 or 206 located behind, or rear of the forward rail vehicle 204 or 206 along the direction of travel may monitor the catenary line 220, third rail 214, or running rail 210 for the neutral section 248. The detection of the neutral section 248 by the rear rail vehicle 204 or 206 may indicate that the rail vehicles 204, 206 are no longer separated by the neutral section 248 and may return to communicating over the catenary line 220, third rail 214, or running rail 210.

In another example, the communication units 256, 258 of the different sides in the consist 202 (such as Catenary A side, Catenary B side, and, the like) may use an algorithm to determine which pathways are used to communicate the message 254 or other data 232. For example, an algorithm may be used to determine if the catenary line 220, third rail 214, or running rail 210 is used to communicate the message 254 or data 232 or if the communication pathway 246 is used to communicate the message 254 or data 232. The algorithm can be used to avoid communication of excessive messages or data from traversing throughout the network formed by the communication pathway 246, the catenary line 220, the third rail 214, and/or the running rail 210. In one embodiment of such an algorithm, the rail vehicles 204, 206 in the consist 202 serially communicate a flag between a plurality of the rail vehicles 204, 206 in the consist 202 to notify the rail vehicles 204, 206 of a status of the communication network over which the messages 254 and/or data 232 can be communicated. For example, the flag may indicate whether one or more neutral sections 248 are present and necessitate two or more rail vehicles 204, 206 or subsets of the rail vehicles 204, 206 to communicate with each other over the on-board communications pathway 246.

The consist 202 may be treated as including N rail vehicles 204, 206 serially connected with each other. The rail vehicles 204, 206 may be numbered 1 through N, with N representing the total number of rail vehicles 204, 206 in the consist 202. As the consist 202 travels along a track, the forward rail vehicles 204, 206 in the consist 202 encounter a neutral section 248 in the catenary line 220, third rail 214, or running rail 210 prior to rear rail vehicles 204, 206 along the direction of travel. For example, the $i^{TH}$ rail vehicle may detect the neutral section 248 before the remaining (N−i) rail vehicles encounter the neutral section 248. As described above, the monitoring module 274 of the $i^{TH}$ rail vehicle may identify the neutral section 248.

Upon identification of the neutral section 248, the monitoring module 274 of the $i^{TH}$ rail vehicle may send a flag to the communication unit 256 of (associated with) the $i^{TH}$ rail vehicle or direct the communication unit 256 of the $i^{TH}$ rail vehicle to transmit a flag (such as a message 254 or data 232). The communication unit 256 communicates the flag to the communication unit 256, 258 of one or more of the rear rail vehicles. For example, the communication unit 256 of the $i^{TH}$ rail vehicle may transmit the flag to the (i+1) rail vehicle in the consist 202, with the (i+1) rail vehicle disposed rear of the $i_{TH}$ rail vehicle along the direction of travel of the consist 202. The flag is communicated over the communication pathway 246 in order to ensure that the (i+1) rail vehicle receives the flag. The (i+1) rail vehicle determines whether to transmit the flag to the rail vehicles disposed rear of the (i+1) rail vehicle, such as the i+1), (i+2) . . . (N−1), and N rail vehicles, or whether to remove the flag from future transmissions to the rear rail vehicles. The (i+1) rail vehicle may determine whether to transmit or withhold the flag from the rear rail vehicles based on the location of the (i+1) rail vehicle relative to the rail vehicle that initiated the flag. For example, if the (i+1) rail vehicle received the flag and the flag was generated by a rail vehicle disposed relatively far away, then the (i+1) rail vehicle may serially communicate the flag to the next rail vehicle, or the (i+2) rail vehicle so that the (i+2) rail vehicle continues to communicate with the rail vehicle that initiated the flag over the communication pathway 246. On the other hand, if the $i^{TH}$ rail vehicle initiated the flag and the (i+1) rail vehicle is disposed adjacent or otherwise near to the $i^{TH}$ rail vehicle, then the (i+1) rail vehicle may disregard the flag in that the (i+1) rail vehicle may continue to communicate with the $i^{TH}$ rail vehicle over the catenary line 220, the third rail 214, or the running rail 210. For example, the $i^{TH}$ and (i+1) rail vehicles may be close enough to each other that the neutral section 248 may only interrupt communication between the rail vehicles for a relatively short time period. The flag continues to be serially communicated to the rear rail vehicles with the rear rail vehicles independently determining whether to disregard the flag or to switch to communicating over the communication pathway 246.

In an embodiment, for communications despite the presence of a neutral section or break, the communication system is configured to implement a method comprising (with reference to FIG. 3): at a first rail vehicle 204 (e.g., a first powered rail vehicle), identifying a neutral section 248 between a first block 250 of the third rail or catenary line and a second block 252 of the third rail or catenary line, the first and second blocks being electrically isolated from one another; at the first rail vehicle 204, transmitting the message 254 over the first block 250 to a first processor or other off-board communication unit 256, wherein the message 254 relates to the neutral section 248; at the first powered rail vehicle 204, transmitting the data 232 over the first block 250 to the first off-board communication unit 256; at the first off-board communication unit 256, transmitting the data 232 to a second off-board communication unit 258 over a communication pathway 246 independent of the rail vehicle consist 202 and the third rail 214, catenary line 220, or running rail 210; and at the second off-board communication unit 258, transmitting the data 232 to the second powered rail vehicle 206 over the second block 252 of the third rail 214, catenary 220, or running rail 10.

Figure 4:
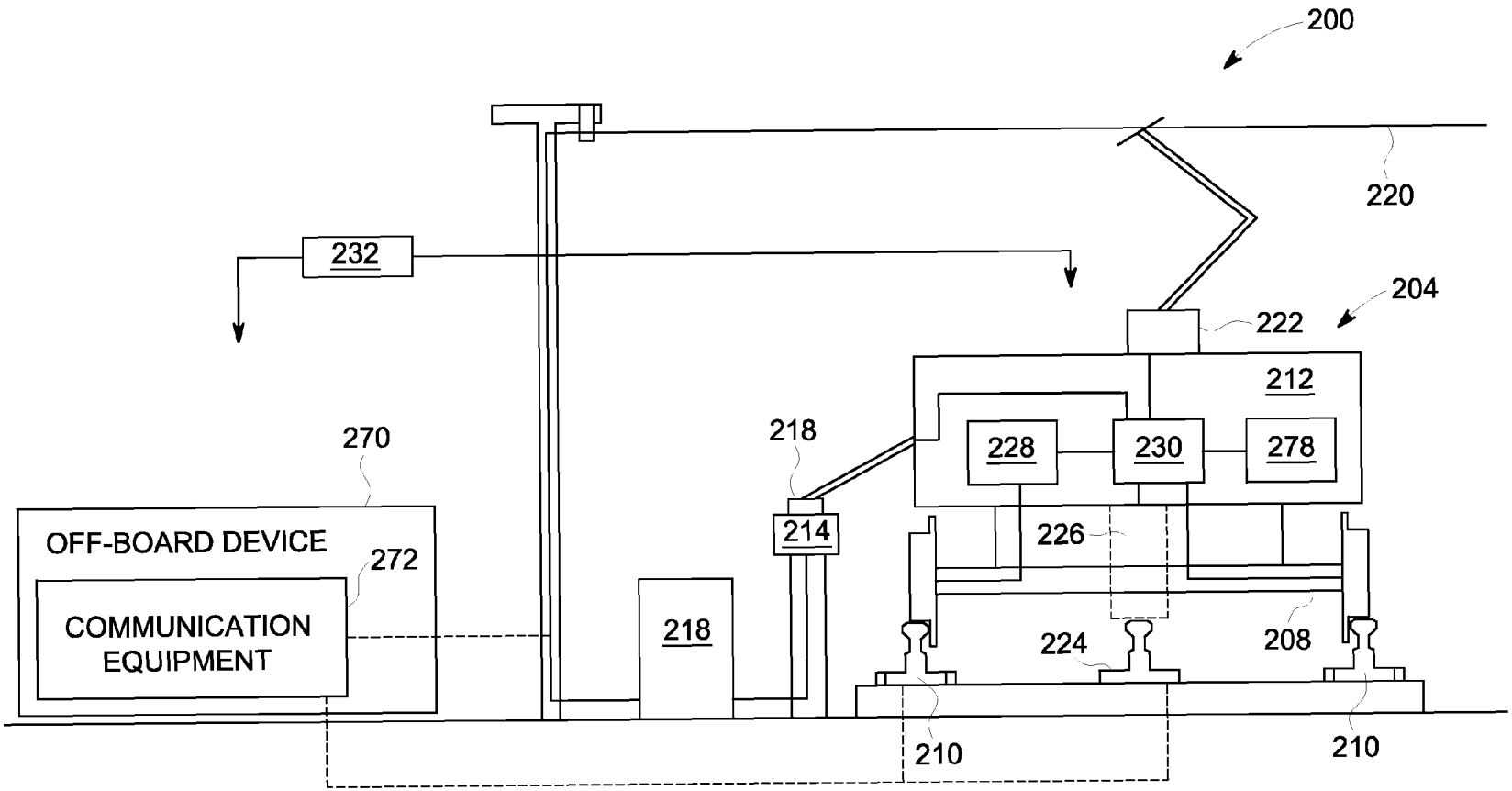
FIG. 4 is a schematic of another embodiment of the communication system.

Other embodiments relate to a method and system for communicating with a rail vehicle to and/or from an off-board or off-track location. With reference to FIG. 4, the system 200 may be used to communicate data 232 between one or more rail vehicles 204, 206 of the consist 202 with an off-board location or device 270. The off-board location 270 may be a dispatch center or other control center, a wayside device, or otherwise.

The data 232 is transmitted from the rail vehicle 204 to the off-board location 270 over the running rail 210, the third rail 214, and/or the catenary line 220. Communication equipment 272 may be provided at the off-board location 270 to facilitate transmission and/or reception of the data 232 to and/or from the rail vehicle 204. The communication equipment 272 can include one or more transmitters, receivers, transceivers, and the like, such as router transceiver units that are similar to the router transceiver units 228 and/or monitoring modules that are similar to the monitoring modules 274. The communication equipment 272 may be configured for monitoring the running rail 210, third rail 214, and/or catenary 220 for identifying and/or receiving the data 232. For example, the communication equipment 272 can periodically examine the running rail 210, third rail 214, and/or catenary line 220 to determine if data 232 is being transmitted along the running rail 210, third rail 214, or catenary line 220. As described above, the data 232 may be network data, and/or high-bandwidth network data.

In another embodiment, the off-board location 270 may transmit data 232 to the rail vehicle 204 over the running rail 210, third rail 214, and/or the catenary 220. The router transceiver unit 228 on the rail vehicle 204 may monitor the running rail 210, third rail 214, and/or catenary 220 to determine if the off-board location 270 is transmitting data 232 to the rail vehicle 204. The router transceiver unit 228 receives the data 232 from the off-board location 270.

In an embodiment, data 232 (such as network data, and/or high-bandwidth network data) is transmitted from one location to another (e.g., rail vehicle, off-board location) concurrently over two or more of a running rail 210, third rail 224, and/or catenary 220, for redundancy and/or communication backup purposes. For example, one or more common or identical messages 254 or sets of data 232 may be communicated at the same time or over at least partially overlapping, time periods using two or more of the running rails 210, third rail 214, and/or catenary line 220. One of the running rails 210, third rail 214, or catenary line 220 may be referred to as the primary communication pathway while another of the running rail 210, third rail 214, or catenary line 220 can be referred to as the backup or secondary communication path. The primary and backup communication paths can be used for communicating the data 232 between rail vehicles 204, 206 and/or between one or more rail vehicles 204, 206 and the off-board location 270. In one embodiment, one copy of the data 232 is sent over the primary communication pathway (such as over the running, rail 210) and another copy of the data 232 is sent over the backup communication pathway (such as the third rail 214 or catenary line 220). The router transceiver units 228 on the rail vehicles 204, 206 and/or the communication equipment 272 of the off-board location 270 may be communicatively coupled with both the primary and backup communication paths such that the router transceiver units 228 and/or communication equipment 272 can communicate the data 232 over both communication paths.

In an embodiment, data 232 (such as network data, and/or high-bandwidth network data) is transmitted from one location to another (e.g., rail vehicle 204, 206 and/or the off-board location 270) over one or more of a set of communication pathways, such as the running rail 210, the third rail 214, the catenary 220, or other communication path, such as a wireless connection or intra-consist wired connection (e.g., MU cable or ECP brake line). The communication pathway that is used to transmit the data 232 may change based on one or more factors, such as an availability of the communication paths, respective signal transmission qualities over the communication paths, and data redundancy.

With respect to the availability factor, the decision of which communication pathway is used to transmit the data 232 may be based on which communication paths are available (i.e., extend between and provide communication from a transmitting device and a receiving device). For example, if two rail vehicles 204, 206 are not coupled by the catenary line 220 or the third rail 214, then one or more running rails 210 and/or another communication pathway (i.e., wireless connection, MU cable, or ECP brake line) may be used to transmit the data 232. The monitoring module 274 of one or more of the rail vehicles 204, 206 may monitor the communication paths to determine which paths are available at different times. For example, one or more monitoring modules 274 may transmit test data signals, or "pings," along one or more of the communication paths to another monitoring module 274. If the monitoring module 274 receives the test data signal or ping over the communication path, then the monitoring module 274 sends a response data signal, or acknowledgement, indicating receipt of the ping 274 back to the monitoring module 274 that originated the test data signal. Receipt of the acknowledgement provides proof of the availability of the communication pathway for transmission of data 232.

With respect to the signal transmission qualities of the communication pathways, Quality of Service (QoS) parameters of the communication pathways may be used to determine which communication pathways are used to transmit the data 232. A QoS parameter may be a measurement of the ability of a communication pathway to transmit the data 232 at a predetermined transmission rate, data flow, throughput, or bandwidth. For example, the QoS parameter may be a comparison of the actual transmission rate of the catenary line 220, third rail 214, or running rail 210 with a predetermined threshold transmission rate of the catenary line 220, third rail 214, or running rail 210. Alternatively, the QoS parameter may be a measurement of dropped packets of the data 232 that are transmitted through the catenary line 220, third rail 214, or running rail 210. In another example, the QoS parameter may be a measurement of a delay or latency of the data 232 communicated over the catenary line 220, third rail 214, or running rail 210. In another embodiment, the QoS parameter is a measurement of jitter or delays among the data packets of the data 232, an order of delivery of various data packets in the data 232, and/or an error in transmitting one or more of the data packets in the data 232.

One or more of the monitoring modules 274 on the rail vehicles 204, 206 and/or the communication equipment 272 of the off-board location 270 may measure the QoS parameters of the communication paths. In one embodiment, a master or lead monitoring module 274 of a consist 202 measures the QoS parameter and dictates which communication path(s) are to be used by the other monitoring modules 274 in the consist 202.

With respect to data redundancy, one or more of the monitoring modules 274 in a consist 202 and/or the communication equipment 272 of the off-board location 270 may determine which of several communication paths are to be used to communicate the data 232 and a copy of the data 232 as a redundant, backup copy of the data. For example, the master monitoring module 274 may identify which communication pathway has a larger QoS parameter than one or more other communication paths and use the communication pathway with the larger QoS parameter as the primary communication channel. Another communication path, such as the communication pathway having a smaller QoS parameter than the primary communication pathway but a QoS parameter that is larger than one or more other communication paths, may be identified as the backup communication channel. The monitoring modules 274 and/or communication equipment 272 may transmit data 232 along the primary and backup communication paths as described above. In another example, three or more communication paths are available, such as a wireless connection, the running rail 210, and the catenary line 220, the data 232 can be communicated over the communication pathway having the best QoS parameter, and, if redundancy is desired, also communicated over the communication pathway having the second best QoS parameter, or over all three communication paths if more redundancy is desired.

The embodiments described above (and in the accompanying claims) may be implemented, in whole or in part, according to portions of the following examples. Other hardware may be used to implement one or more embodiments described herein.

Figure 5:
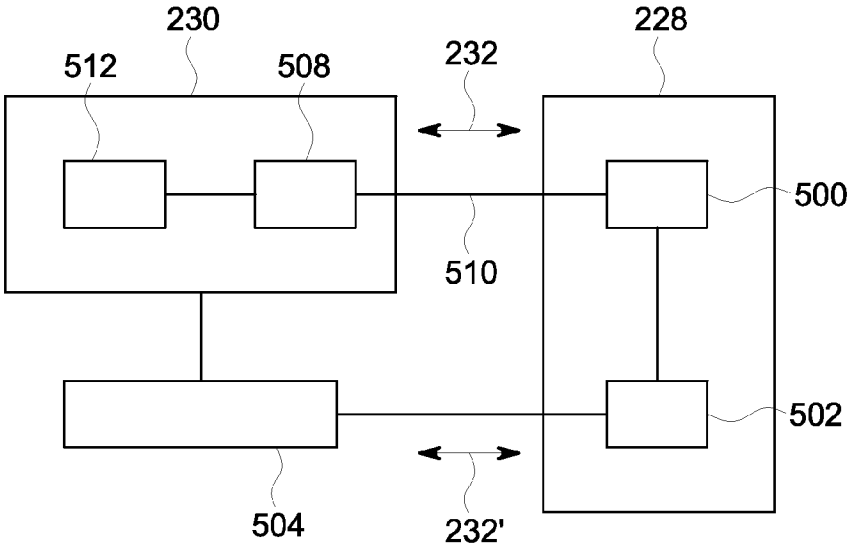
FIG. 5 shows one embodiment of a router transceiver unit shown in FIG. 2 in more detail in one embodiment.

FIG. 5 shows one embodiment of a router transceiver unit 228 in more detail. The router transceiver unit 228 comprises a network adapter module 500 and a signal modulator module 502. The signal modulator module 502 is electrically connected to a network adapter module 500 and to a communication pathway 504. The communication pathway 504 represents the catenary line 220, third rail 214, and/or running rail 210 over which the router transceiver unit 228 communicates the data 232. In the example shown in FIG. 5, the signal modulator module 502 is electrically connected to the communication pathway 504 by way of a terminal board, near the electric system 230 disposed on-board the rail vehicle 204, 206. The electric system 230 may be, for example, a computer unit or processor adapted to control one or more operations, such as tractive or braking operations, of the rail vehicle 204, 206. The network adapter module 500 is electrically connected to a network interface unit 508 that is part of and/or operably connected to the electric system 230. The network adapter module 500 and network interface unit 508 may be electrically interconnected by a network cable or bus 510. For example, if the network adapter module 500 and network interface unit 508 are configured as an Ethernet local area network, the network cable or bus 510 may be a CAT-5E cable. The network interface unit 508 is functionally connected to one or more software or hardware applications 512 in the electric system 230 that are configured for network communications. The applications 512 may be embodied in or represent one or more sets of instructions stored on a tangible and non-transitory computer readable storage medium (e.g., computer hard drive, flash drive, RAM, ROM, and the like) that direct a computer processor to perform one or more operations.

In one embodiment, the network interface unit 508, network cable or bus 510, and applications 512 include standard Ethernet-ready (or other network) components. For example, if the electric system 230 is a computer unit, the network interface unit 508 may be an Ethernet adapter connected to computer unit far carrying out network communications.

The network adapter module 500 is configured to receive data 232 from the network interface unit 508 over the network cable or bus 510. The network adapter module 500 conveys the data 232 to the signal modulator module 502, which modulates the data 232 into modulated data 232' and transmits the modulated data 232' over the communication pathway 504. The signal modulator module 502 also receives modulated data 232' from over the communication pathway 504 and de-modulates the modulated data 232' into data 232, which the signal modulator module 502 then conveys to the network adapter module 500 for transmission to the network interface unit 508. One or both of the network adapter module 500 and the signal modulator module 502 may perform various processing steps on the data 232 and/or the modulated data 232' for transmission and reception both over the communication pathway 504 and/or over the network cable or bus 510 (to the network interface unit 508). Additionally, one or both of the network adapter module 500 and the signal modulator module 502 may perform network data routing functions.

The signal modulator module 502 may include an electrical output (e.g., port, wires, shoe 216, pantograph 222, conductive pathway that couples the module 502 to the wheel set 208, and the like) for electrical connection to the communication pathway 504, and internal circuitry (e.g., electrical and isolation components, microcontroller, software/firmware) for receiving data 232 from the network adapter module 500, modulating the data 232 into modulated data 232', transmitting the modulated data 232' over the communication pathway 504, receiving modulated data 232' over the communication pathway 504, de-modulating the modulated data 232' into data 232, and communicating the data 232 to the network adapter module 500.

The internal circuitry of the signal modulator module 502 may be configured to modulate and de-modulate data using schemes such as those utilized in VDSL or VHDSL (very high bitrate digital subscriber line) applications, or in power line digital subscriber line (PDSL) applications. One example of a suitable modulation scheme is orthogonal frequency-division multiplexing (OFDM). OFDM is a frequency-division multiplexing scheme wherein a large number of closely-spaced orthogonal sub-carriers are used to carry data. The data is divided into several parallel data streams or channels, one for each sub-carrier. Each sub-carrier is modulated with a conventional modulation scheme (such as quadrature amplitude modulation or phase shift keying) at a low symbol rate, maintaining total data rates similar to conventional single-carrier modulation schemes in the same bandwidth. The modulation or communication scheme may involve applying a carrier wave (at a particular frequency orthogonal to frequencies used for non-network data in the communication pathway 504) and modulating the carrier wave using digital signals corresponding to the data 232.

Figure 6:
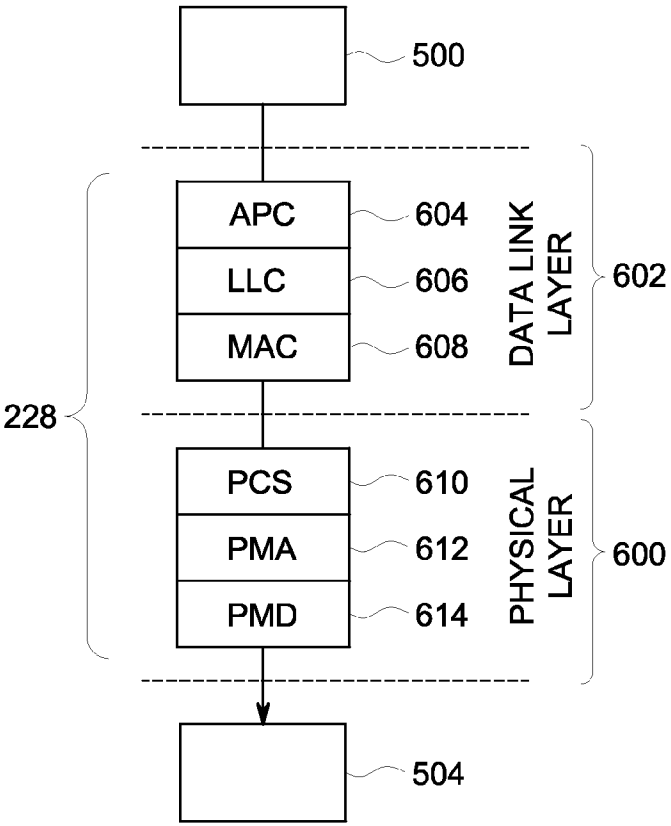
FIG. 6 shows one possible example of how a signal modulator module shown in FIG. 1 could function, cast in terms of the OSI network model, according to one embodiment.

FIG. 6 shows one possible example of how the signal modulator module 228 could function, cast in terms of the OSI network model, according to one embodiment. In this example, the signal modulator module 228 includes a physical layer 600 and a data link layer 602. The data link layer 602 is divided into three sub-layers. The first sub-layer is an application protocol convergence (APC) layer 604. The APC layer accepts Ethernet (or other network) frames from an upper application layer (e.g., the network adapter module 500) and encapsulates them into MAC (medium access control) service data units, which are transferred to a logical link control (LLC) layer 606. The LLC layer 606 is responsible for potential encryption, aggregation, segmentation, automatic repeat-request, and similar functions. The third sub-layer of the data link layer 602 is a MAC layer 608, which schedules channel access. The physical layer 600 is divided into three sub-layers. The first sub-layer is a physical coding sub-layer (PCS) 610, which is responsible for generating PHY (physical layer) headers. The second sub-layer is a physical medium attachment (PMA) layer 612, which is responsible for scrambling and FEC (forward error correction) coding/decoding. The third sub-layer is a physical medium dependent (PMD) layer 614, which is responsible for bit-loading and OFDM modulation. The PMD layer 614 is configured for interfacing with the communication pathway 504, such as the catenary line 220, the third rail 214, and/or the running rail 210, according to the particular configuration (electrical or otherwise) of the communication pathway 504. The other sub-layers are medium independent, i.e., do not depend on the configuration of the communication pathway 504.

Figure 7:
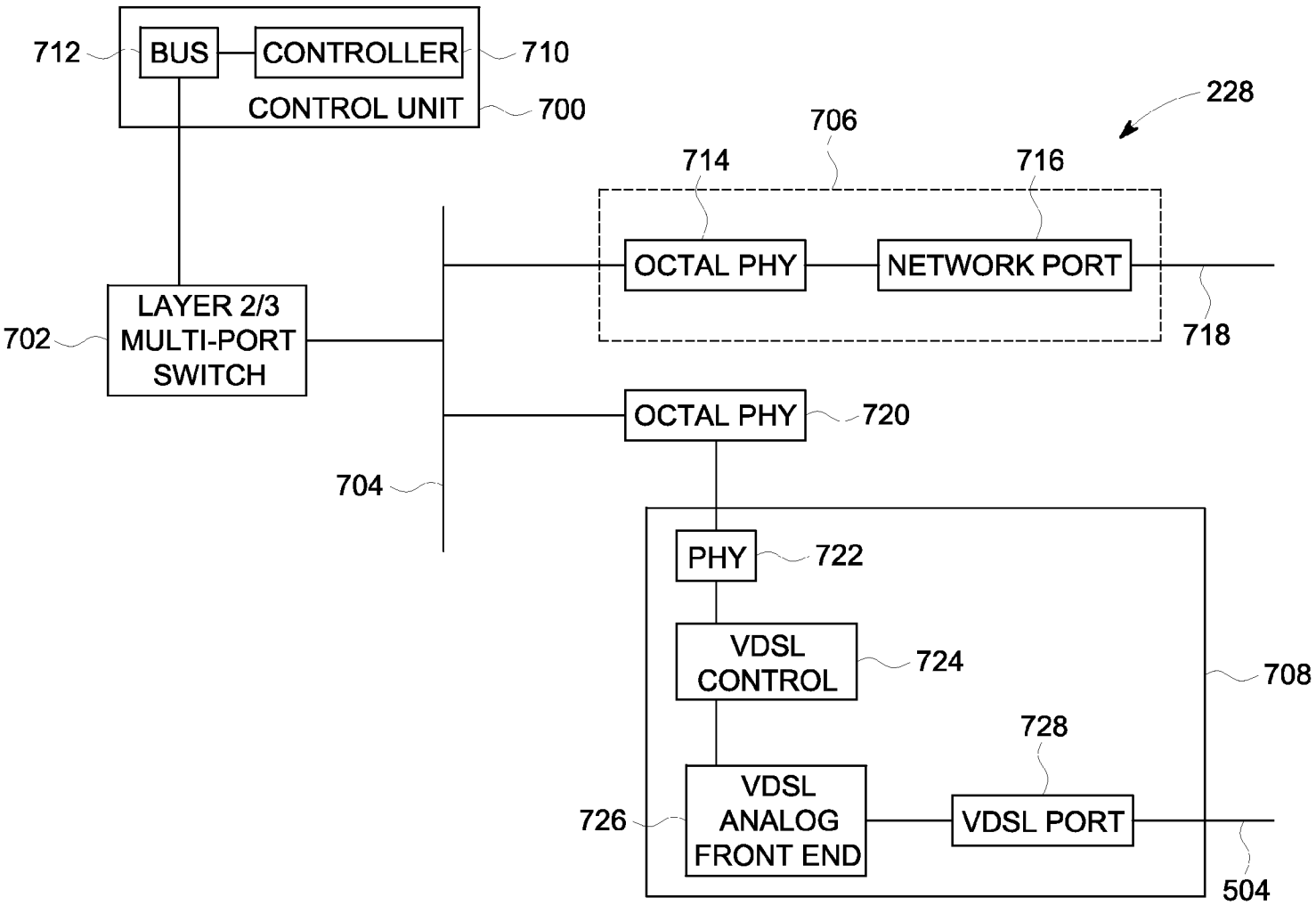
FIG. 7 is a circuit diagram of another embodiment of a router transceiver unit.

FIG. 7 is a circuit diagram of another embodiment of a router transceiver unit 228. In this embodiment, the router transceiver unit 228 comprises a control unit 700, a switch 702, a main bus 704, a network interface portion 706, and a Very High Digital Subscriber Line (VDSL) module 708. The control unit 700 comprises a controller 710 and a control unit bus 712. The controller 710 is electrically connected to the control unit bus 712 for communicating data 232 over the bus 712. The controller 710 may be a microcontroller or other processor-based unit, including support circuitry for the microcontroller. The switch 702 may be a network switching/router module configured to process and route data 232. The switch 702 interfaces the control unit 700 with the main bus 704. The switch 702 may be, for example, a layer 2/3 multiport switch. The network interface portion 706 is electrically connected to the main bus 704, and comprises an octal PHY (physical layer) portion 714 and a network port portion 716. The network port portion 716 is electrically connected to the octal PHY portion 714. The octal PHY portion 711 may comprise a 10/100/1000 Base T 8-port Ethernet (or other network) transceiver circuit. The network port portion 716 may comprise an Ethernet (or other network) transformer and associated CAT-5E receptacle (or other cable type receptacle) for receiving a network cable 718.

The VDSL module 708 also is connected to the main bus 704 by way of an octal PHY unit 720, which may be the same unit as the octal PITY portion 714 or a different octal PHY unit. The VDSL module 708 comprises a physical interface portion (PHY) 722 electrically connected to the octal PHY unit 720, a VDSL control 724 electrically connected to the physical interface portion 722, a VDSL analog front end unit 726 electrically connected to the VDSL control 724, and a VDSL port unit 728 electrically connected to the VDSL analog front end unit 726. The physical interface portion 722 acts as a physical and electrical interface with the octal PHY unit 720, the physical interface portion 722 may comprise a port and related support circuitry. The VDSL analog front end unit 726 is configured for transceiving data 232 (e.g., sending and receiving modulated data) over the communication pathway 504 (such as the catenary line 220, third rail 214, and/or running rail 210), and may include one or more of the following: analog filters, line drivers, analog-to-digital and digital-to-analog converters, and related support circuitry (e.g., capacitors). The VDSL control 724 is configured for converting and/or processing data 232 for modulation and de-modulation, and may include a microprocessor unit, ATM (asynchronous transfer mode) and IP (Internet Protocol) interfaces, and digital signal processing circuitry/functionality. The VDSL port unit 728 provides a physical and electrical connection to the communication pathway 504, and may include transformer circuitry, circuit protection functionality, and a port or other attachment or connection mechanism for connecting the VDSL module 708 to the communication pathway 504. Overall operation of the router transceiver unit 228 shown in FIG. 7 is similar to what is described in relation to FIGS. 1 through 6.

As should be appreciated, it may be the case that certain rail vehicles 204, 206 in the consist 202 are network equipped according to the system and method of one or more embodiments described herein, e.g., outfitted with a router transceiver unit 228, and that other rail vehicles 204, 206 in the consist 202 are not. For example, there may be first and third network-equipped rail vehicles 204, 206 physically separated by a second rail vehicle that is not network equipped. In this case, the first and third rail vehicles 204, 206 are still able to communicate and exchange data even though there is a non-network equipped rail vehicle between them.

Another embodiment relates to a method for retrofitting a consist 202 of rail vehicles 204, 206 for data communications between each other over a communication pathway such as the catenary line 220, third rail 214, or running rail 210. The method comprises outfitting a plurality of rail vehicles 204, 206 with router transceiver units 228, interfacing the router transceiver units 228 with electronic components 230 of the rail vehicles 204, 206, and interfacing the router transceiver units 228 with the catenary line 220, third rail 214, or running rail 210.

In another embodiment, a method for communicating data in a rail vehicle consist is provided. The method includes transmitting first data at a first rail vehicle of the consist over a power supply conductor (e.g., off-board power supply conductor) to a second, different rail vehicle in the consist, where at least one rail vehicle of the consist receives direct electrical power from the power supply conductor. The method also includes monitoring the power supply conductor for second data at the first rail vehicle and receiving the second data over the power supply conductor at the first rail vehicle for use by a first system onboard the first rail vehicle.

In another aspect, the power supply conductor comprises one or more of a catenary line or a third rail that supplies the electrical power, and the transmitting step comprises transmitting the first data over one or more of the catenary line or the third rail.

In another aspect, method also includes controlling at least one of tractive effort or braking effort provided by the first rail vehicle based on the received second data.

In another aspect, at least one of the transmitting step or the receiving step includes communicating the first data or the second data to convey sensor data obtained on the first rail vehicle or the second rail vehicle to the other of the first rail vehicle or the second rail vehicle.

In another aspect, each of the first data and/or the second data is high-bandwidth network data.

In another aspect, the method also includes identifying a neutral section in the power supply conductor between the first rail vehicle and the second rail vehicle that inhibits communication of the first data or second data between the first rail vehicle and the second rail vehicle.

In another aspect, the method also includes switching to an auxiliary communication pathway when the neutral section is identified. The auxiliary communication pathway extends across the neutral section. The method also may include transmitting the first data or receiving the second data over the auxiliary communication pathway.

In another aspect, the transmitting step comprises redundantly transmitting the first data to the second rail vehicle over the power supply conductor and at least one additional communication pathway that extends between the first rail vehicle and the second rail vehicle.

In another aspect, the power supply conductor is a catenary line or a third rail and the additional communication pathway is at least one of the catenary line, the third rail, a running rail over which the rail vehicle consist travels, a cable bus extending between the first rail vehicle and the second rail vehicle, or a wireless connection between the first rail vehicle and the second rail vehicle.

In another embodiment, a communication system for a rail vehicle in a rail vehicle consist is provided. The system includes an interface module and a transceiver unit. The interface module is configured to be electrically coupled to a power supply conductor that supplies direct electrical power to at least one rail vehicle in the consist. The transceiver unit is coupled to the interface module and is configured to at least one of transmit or receive data over the power supply conductor through the interface module.

In another aspect, the transceiver unit is configured to at least one of transmit the data or receive the data from another, different rail vehicle in the rail vehicle consist.

In another aspect, the power supply conductor comprises one or more of a catenary line or a third rail that supplies the electrical power, and the transceiver unit is configured to at least one of transmit or receive the data over the one or more of the catenary line or the third rail.

In another aspect, the transceiver unit is configured to be coupled to a first system disposed on-board the rail vehicle that uses the data received over the power supply conductor.

In another aspect, the system also includes a monitoring module coupled to the interface module that is configured to identify a neutral section in the power supply conductor that inhibits communication of the data over the power supply conductor.

In another aspect, the transceiver unit is configured to switch to transmitting the data over an auxiliary communication pathway when the neutral section is identified, where the auxiliary communication pathway extends across the neutral section.

In another aspect, the transceiver unit is configured to transmit the data over the power supply conductor and at least one additional communication pathway that extends between the rail vehicle and another, different rail vehicle in the rail vehicle consist.

In another aspect, the power supply conductor is a catenary line or a third rail and the additional communication pathway is at least one of the catenary line, the third rail, a running rail over which the rail vehicle consist travels, a cable bus, or a wireless connection.

In another embodiment, another communication system for a rail vehicle in a rail vehicle consist is provided. The system includes an interface module, a transceiver unit, and a monitoring module. The interface module is configured to be electrically coupled to a power supply conductor (e.g., off-board power supply conductor) that supplies direct electrical power to at least one rail vehicle in the consist. The transceiver unit is coupled to the interface module. The transceiver unit is configured to communicate data over the power supply conductor through the interface module. The monitoring module is coupled to the transceiver unit and is configured to monitor the power supply conductor and determine a signal transmission characteristic of the power supply conductor.

The transceiver unit switches from communicating the data over the power supply conductor to communicating the data over an auxiliary communication pathway that extends across a neutral section of the power supply conductor based on the signal transmission characteristic.

In another aspect, the monitoring module identifies a neutral section in the power supply conductor based on the signal transmission characteristic, and the transceiver unit switches to communicating the data over the on-board communication pathway when the neutral section is identified.

In another aspect, the transceiver unit is configured to concurrently communicate the data over the power supply conductor and the on-board communication pathway.

In another aspect, the power supply conductor is at least one of a third rail or a catenary line.

Any of the embodiments described herein are also applicable for communicating data in vehicle consists generally, "Vehicle consist" refers to a group of vehicles that are mechanically coupled or linked together to travel along a route.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the disclosed subject matter, they are by no means limiting and are exemplary embodiments. Many other embodiments will be apparent to those of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode and also to enable any person of ordinary skill in the art to practice the embodiments of invention, including making and using any devices or systems and performing any incorporated methods. The patentable scope of the invention is defined by the claims, and may include other examples that occur to those ordinarily skilled in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present invention will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described communication system and method for vehicle consist, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method for communicating data in a rail vehicle consist, the method comprising:

at a first rail vehicle in the rail vehicle consist:

transmitting first data over a power supply conductor that is disposed off-board the rail vehicle consist to a second, different rail vehicle in the rail vehicle consist, wherein at least one rail vehicle of the rail vehicle consist receives direct electrical power from the power supply conductor;

monitoring the power supply conductor for second data; and receiving the second data over the power supply conductor for use by a first system onboard the first rail vehicle.

2. The method of claim 1, wherein the power supply conductor comprises one or more of a catenary line or a third rail that supplies the electrical power, and the transmitting step comprises transmitting the first data over one or more of the catenary line or the third rail.

3. The method of claim 1, further comprising controlling at least one of tractive effort or braking effort provided by the first rail vehicle based on the received second data.

4. The method of claim 1, wherein at least one of the transmitting step or the receiving step includes communicating the first data or the second data to convey sensor data obtained on the first rail vehicle or the second rail vehicle to the other of the first rail vehicle or the second rail vehicle.

5. The method of claim 1, wherein at least one of the first data or the second data is high-bandwidth network data.

6. The method of claim 1, wherein the transmitting step comprises redundantly transmitting the first data to the second rail vehicle over the power supply conductor and at least one additional communication pathway that extends between the first rail vehicle and the second rail vehicle by transmitting the same first data from the first rail vehicle to the second rail vehicle over both the power supply conductor and the at least one additional communication pathway.

7. The method of claim 6, wherein the power supply conductor is a catenary line disposed off-board the rail vehicle consist or a third rail disposed off-board the rail vehicle consist, and the additional communication pathway is at least one of the catenary line, the third rail, a running rail disposed off-board the rail vehicle consist and over which the rail vehicle consist travels, a cable bus extending between the first rail vehicle and the second rail vehicle, or a wireless connection between the first rail vehicle and the second rail vehicle.

8. A method for communicating data in a rail vehicle consist, the method comprising:

at a first rail vehicle in the rail vehicle consist:

transmitting first data over a power supply conductor to a second, different rail vehicle in the rail vehicle consist, wherein at least one rail vehicle of the rail vehicle consist receives direct electrical power from the power supply conductor;

monitoring the power supply conductor for second data;

receiving the second data over the power supply conductor for use by a first system onboard the first rail vehicle; and identifying a neutral section in the power supply conductor between the first rail vehicle and the second rail vehicle that inhibits communication of the first data or second data between the first rail vehicle and the second rail vehicle.

9. The method of claim 8, further comprising switching to an auxiliary communication pathway when the neutral section is identified, the auxiliary communication pathway extending across the neutral section, and at least one of transmitting the first data or receiving the second data over the auxiliary communication pathway.

10. A communication system for a rail vehicle in a rail vehicle consist, the system comprising:

an interface module configured to be electrically coupled to a power supply conductor that is disposed off-board the rail vehicle consist and that supplies direct electrical power to at least one rail vehicle in the consist; and a transceiver unit coupled to the interface module and configured to at least one of transmit or receive data over the power supply conductor through the interface module.

11. The system of claim 10, wherein the transceiver unit is configured to at least one of transmit the data to or receive the data from another, different rail vehicle in the rail vehicle consist over the power supply conductor.

12. The system of claim 10, wherein the power supply conductor comprises one or more of a catenary line or a third rail that supplies the electrical power, and the transceiver unit is configured to at least one of transmit or receive the data over the one or more of the catenary line or the third rail.

13. The system of claim 10, wherein the transceiver unit is configured to be coupled to a first system disposed on-board the rail vehicle that uses the data received over the power supply conductor.

14. The system of claim 10, wherein the transceiver unit is configured to transmit the data over the power supply conductor and at least one additional communication pathway that extends between the rail vehicle and another, different rail vehicle in the rail vehicle consist.

15. The system of claim 14, wherein the power supply conductor is a catenary line disposed off-board the rail vehicle consist or a third rail disposed off-board the rail vehicle consist, and the additional communication pathway is at least one of the catenary line, the third rail, a running rail disposed off-board the rail vehicle consist and over which the rail vehicle consist travels, a cable bus, or a wireless connection.

16. A communication system for a rail vehicle in a rail vehicle consist, the system comprising:

an interface module configured to be electrically coupled to a power supply conductor that supplies direct electrical power to at least one rail vehicle in the consist;

a transceiver unit coupled to the interface module and configured to at least one of transmit or receive data over the power supply conductor through the interface module; and a monitoring module coupled to the interface module, the monitoring module configured to identify a neutral section in the power supply conductor that inhibits communication of the data over the power supply conductor.

17. The system of claim 16, wherein the transceiver unit is configured to switch to transmitting the data over an auxiliary communication pathway when the neutral section is identified, the auxiliary communication pathway extending across the neutral section.

18. A communication system for a rail vehicle in a rail vehicle consist, the system comprising:

an interface module configured to be electrically coupled to a power supply conductor that supplies direct electrical power to at least one rail vehicle in the consist;

a transceiver unit coupled to the interface module, the transceiver unit configured to communicate data over the power supply conductor through the interface module; and a monitoring module coupled to the transceiver unit, the monitoring module configured to monitor the power supply conductor and determine a signal transmission characteristic of the power supply conductor, wherein the transceiver unit switches from communicating the data over the power supply conductor to communicating the data over an auxiliary communication pathway that extends across a neutral section of the power supply conductor based on the signal transmission characteristic.

19. The communication system of claim 18, wherein the auxiliary communication pathway is disposed on-board the rail vehicle consist.

20. The communication system of claim 18, wherein the transceiver unit is configured to concurrently communicate the data over the power supply conductor and the auxiliary communication pathway.

21. The communication system of claim 18, wherein the power supply conductor is at least one of a third rail or a catenary line.

* * * * *